US007661213B2

(12) United States Patent
Gainey

(10) Patent No.: US 7,661,213 B2
(45) Date of Patent: Feb. 16, 2010

(54) YARD SIGN ASSEMBLY

(76) Inventor: Brantley K. Gainey, 1823 S. Fifth St., Hartsville, SC (US) 29550

( * ) Notice: Subject to any disclaimer, the term of this patent is extended or adjusted under 35 U.S.C. 154(b) by 57 days.

(21) Appl. No.: 12/070,033

(22) Filed: Feb. 14, 2008

(65) Prior Publication Data

US 2009/0205233 A1 Aug. 20, 2009

(51) Int. Cl.
*G09F 15/00* (2006.01)

(52) U.S. Cl. ..... 40/606.18; 40/607.1; 40/606.19

(58) Field of Classification Search ..... 40/606.18, 40/607.03, 607.1, 606.01, 606.19, 584; 116/63 P
See application file for complete search history.

(56) References Cited

U.S. PATENT DOCUMENTS

| | | | | |
|---|---|---|---|---|
| 3,643,362 | A | 2/1972 | Hackett et al. | |
| 4,068,398 | A | 1/1978 | Parisi | |
| 4,263,738 | A | 4/1981 | Donatelle | |
| 4,276,706 | A | 7/1981 | Scott | |
| 4,327,514 | A | 5/1982 | Bourque | |
| 4,604,820 | A | 8/1986 | Edman | |
| 4,641,448 | A | 2/1987 | Cobb et al. | |
| 4,642,946 | A * | 2/1987 | Koch | 52/38 |
| 4,658,527 | A * | 4/1987 | Pingel | 40/607.01 |
| 4,742,633 | A | 5/1988 | Snediker | |
| 4,790,091 | A | 12/1988 | Hull | |
| 4,802,296 | A | 2/1989 | Kovalak, Jr. | |
| 5,012,603 | A | 5/1991 | Elcock | |
| 5,083,390 | A | 1/1992 | Edman | |
| 5,103,582 | A * | 4/1992 | Farmer | 40/607.12 |
| 5,458,428 | A | 10/1995 | West | |
| 5,588,238 | A | 12/1996 | Visocky et al. | |
| 5,729,215 | A * | 3/1998 | Jutras | 340/908.1 |
| 5,903,991 | A | 5/1999 | Sasse | |
| 6,170,183 | B1 * | 1/2001 | Keefe | 40/607.03 |

(Continued)

OTHER PUBLICATIONS

Aluma-Panel Inc., Aluma Core White, Sep. 28, 2009, http://www.alumapanel.com/view_product.cfm?step=1&lines_ID=291&name=Aluma%2DCorr%20White, p. 1.*

(Continued)

*Primary Examiner*—Lesley Morris
*Assistant Examiner*—Kristina Staley
(74) *Attorney, Agent, or Firm*—Harleston Law Firm, LLC

(57) ABSTRACT

A durable yard sign assembly includes: (a) a central message panel including a lightweight, thermoplastic core, lightweight metallic front and rear face sheets, and a plurality of parallel panel apertures within the core; the front and rear face sheets being attached to opposite, front and rear sides of the core; each panel aperture extending from one end of the central panel to the opposite end; (b) two substantially rectangular side posts, each including an open upper end accessing an upper post hollow, each side post including at least two inside side post apertures on an inside wall, and at least one outside side post aperture on an outside wall; (c) at least two panel support rods, each extending through a different one of the panel apertures; (d) at least one pair of support rod connectors, each being connectable to an end portion of the at least two panel support rods; and (e) two removable upper end caps; wherein the yard sign assembly includes an unassembled position for storage or transport, and an assembled, rail-less position. A free-standing double sign is also described herein.

7 Claims, 8 Drawing Sheets

U.S. PATENT DOCUMENTS

| | | | | |
|---|---|---|---|---|
| 6,655,062 | B1 | 12/2003 | Meeker | |
| 7,025,335 | B2 | 4/2006 | Zhu | |
| 7,090,201 | B2 | 8/2006 | Brucker | |
| 7,107,713 | B2 | 9/2006 | Simson et al. | |
| D533,230 | S | 12/2006 | Thomas | |
| 7,150,119 | B1 * | 12/2006 | Nudo, Jr. | 40/615 |
| D537,123 | S | 2/2007 | Thomas | |
| 7,219,457 | B2 | 5/2007 | Carter et al. | |
| 7,437,844 | B1 * | 10/2008 | Kennedy | 40/607.03 |
| 2004/0262486 | A1 | 12/2004 | Allen | |
| 2005/0144824 | A1 | 7/2005 | Carter et al. | |
| 2006/0254103 | A1 | 11/2006 | Strick et al. | |
| 2007/0199221 | A1 | 8/2007 | Carter et al. | |

OTHER PUBLICATIONS

Skiffy, http_skiffy, Sep. 28, 2009, http://skiffy.com, p. 1.*

Aluma-Panel Inc., a sign supply company, Sep. 28, 2009, http://www.alumapanel.com, pp. 1-3.*

Plastic Lumber Yard, Plastic Lumber for all your outdoor needs and then some, Sep. 28, 2009, http://www.plasticlumberyard.com, pp. 1-4.*

Plastic Lumber Yard, Railing Hardware and Accessories, Sep. 28, 2009, http://www.plasticlumberyard.com/pergolaman/railing/postandrailingdrawings.htm, pp. 1-3.*

Plastic Lumber Yard, Post and Rail Vinyl Raw Materials, Sep. 28, 2009, http://www.plasticlumberyard.com/pergolaman/post/119.htm, pp. 1-2.*

Plastic Lumber Yard, Vinyl Raw Materials, Sep. 28, 2009, http://www.plasticlumberyard.com/pergolaman/rawmaterialbundleprice.htm, pp. 1-4.*

Skiffy, Cover cap, Sep. 28, 2009, http://www.skiffy.com/docs/menufr.cfm?taal=gb&ID=xyxz4034743A2&pagina=inhoudfr.cfm&serie=039&pag=serieomschr.cfm&order=order, p. 1.*

Skiffy Products, small parts, big range, Sep. 28, 2009, http://skiffy.com/docs/start.cfm?taal=gb&ID=xyxz4037686A9&pagina=start.cfm, pp. 1-2.*

Skiffy, Sheet cover cap 2, Sep. 28, 2009, http://www.skiffy.com/docs/menufr.cfm?taal=gb&ID=xyxz4034731A8&pagina=inhoudfr.cfm&serie=161&pag=serieomschr.cfm&order=orde, p. 1.*

Skiffy, Sheet cover cap, Sep. 28, 2009, http://www.skiffy.com/docs/infoblad.cfm?taal=gb&ID=xyxz4028618A5&order=order&serie=161, pp. 1-3.*

Aluma-panel Inc., V-115 U Channel, Sep. 28, 2009, http://www.alumapanel.com/view_product.cfm?step=1&lines_ID=321&name=V%2D115%201%2F2%22%20U%20Channel, p. 1.*

Plastic Lumber Yard, Vinyl Raw Materials, Sep. 28, 2009, http://www.plasticlumberyard.com/pergolaman/pvc_vinyl_vinyl_raw_material.htm, pp. 1-3.*

Aluma-Panel Inc., Vinyl Trim Cap, Sep. 28, 2009, http://www.alumapanel.com/products.cfm?step=1&lines_ID=321, pp. 1-2.* www.skiffy.com.

www.plasticlumberyard.com.

www.alumapanel.com.

* cited by examiner

YARD SIGN ASSEMBLY

BACKGROUND OF THE INVENTION

1. Technical Field

The present invention relates to a durable, weather-resistant yard sign that is assembled from synthetic components, as well as a free-standing, "double" sign comprising a first, substantially vertical main sign and a second, substantially horizontal base sign.

2. Background Information

Insubstantial "For Sale" signs twisting in the wind as observers drive past the front yards of houses for sale are difficult to read and present a poor appearance that can reflect on the product being advertised. Such yard signs are easily blown down and/or damaged by adverse weather conditions and impacts with wind blown debris or other objects. Real estate agents, volunteers for politicians, or other advertisers must use their valuable time monitoring such signs and periodically refastening or replacing them. Some conventional yard signs have horizontal rails bordering the top and bottom edges of the sign in an apparent effort to reinforce the sign.

The sturdy yard sign of the present invention includes at least two hidden support rods that extend through the central message panel of the sign into the sign's side posts. Support rod connectors within the two sign side posts are easily accessible to the user, yet not apparent to passers by. The central message panel of the present invention is incorporated into the sign, and contributes to the strength and durability of the sign of the present invention. The present yard signs need not be continuously monitored and replaced. No rails are needed along the top and bottom edges of the yard sign of the present invention. The yard sign of the present invention is made of a synthetic material for durability.

In addition to sturdiness, an attractive and clean appearance is a desirable characteristic for a yard sign to have, since the sign's appearance reflects on the product advertised in the message. An observer is more likely to conclude that a business with attractive, clean, sturdy signs advertising it is also solid and up-front. The fact that the panel support rods and support rod connectors of the present yard sign are hidden contributes to the attractive, clean appearance of the assembled sign. The lack of rails also makes the sign easier to assemble and more attractive, and means that the entire panel space can be used for advertising.

BRIEF SUMMARY OF THE INVENTION

The present invention is a yard sign assembly, which includes: (a) a central message panel comprising a lightweight, thermoplastic core, a lightweight metallic front face sheet, a lightweight metallic rear face sheet, and a plurality of panel apertures within the core; the front and rear face sheets being attached to opposite, front and rear sides of the core; each panel aperture extending from one end of the central panel to an opposite end of the central panel along a longitudinal axis of the central panel, the panel apertures being substantially parallel to one another; (b) two side posts, each side post comprising an open upper end accessing an upper post hollow, each side post being substantially rectangular in cross-section, each side post comprising at least two inside side post apertures on an inside wall of each of the side posts, and at least one outside side post aperture on an outside wall of each of the side posts; (c) at least two panel support rods, each support rod extending through a different one of the panel apertures from one end of the central panel to the opposite end of the central panel; (d) at least one pair of support rod connectors, each support rod connector being connectable to an end portion of the at least two panel support rods; and (e) two removable upper end caps, one end cap fitting over the open upper end of each of the side posts; wherein the yard sign assembly comprises an unassembled position for storage or transport, and an assembled, rail-less position for use.

When the yard sign is assembled, the two side posts are substantially parallel to one another with the central panel between the side posts, the at least two support rods are substantially parallel to and spaced apart from one another and each extend substantially perpendicularly to a longitudinal axis of the side posts, and opposite end portions of each of the at least two support rods extend into the side post hollow through corresponding ones of the at least two inside side post apertures in each of the side posts.

Also included herein is a free-standing, double yard sign, comprising: a first, main sign and a second, base sign. The second, substantially horizontal base sign is substantially perpendicular to and supports the first, substantially vertical main sign. Each sign includes: (a) the central message panel; (b) two side posts; (c) at least two panel support rods; (d) at least one pair of support rod connectors for each of the panel support rods; and (e) the two removable upper end caps. The side posts of the second, base sign comprise a central punch out, a lower end of each of the side posts of the first, main sign being attached in the central punch out of a corresponding one of the side posts of the second, base sign. The side posts of the second, base sign are substantially wider than the side posts of the first, main sign.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
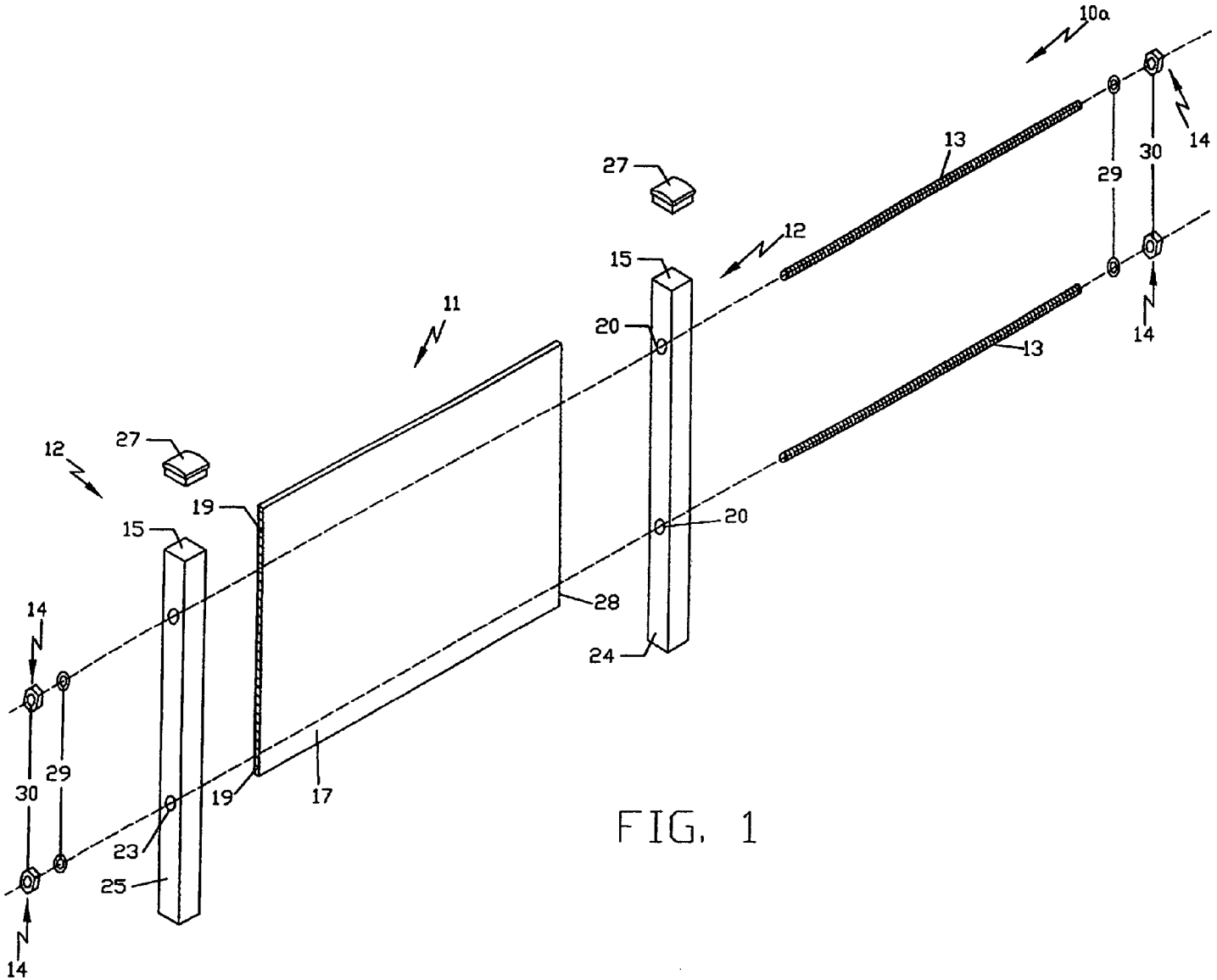
FIG. 1 is an exploded perspective view of a yard sign assembly according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Figure 2:
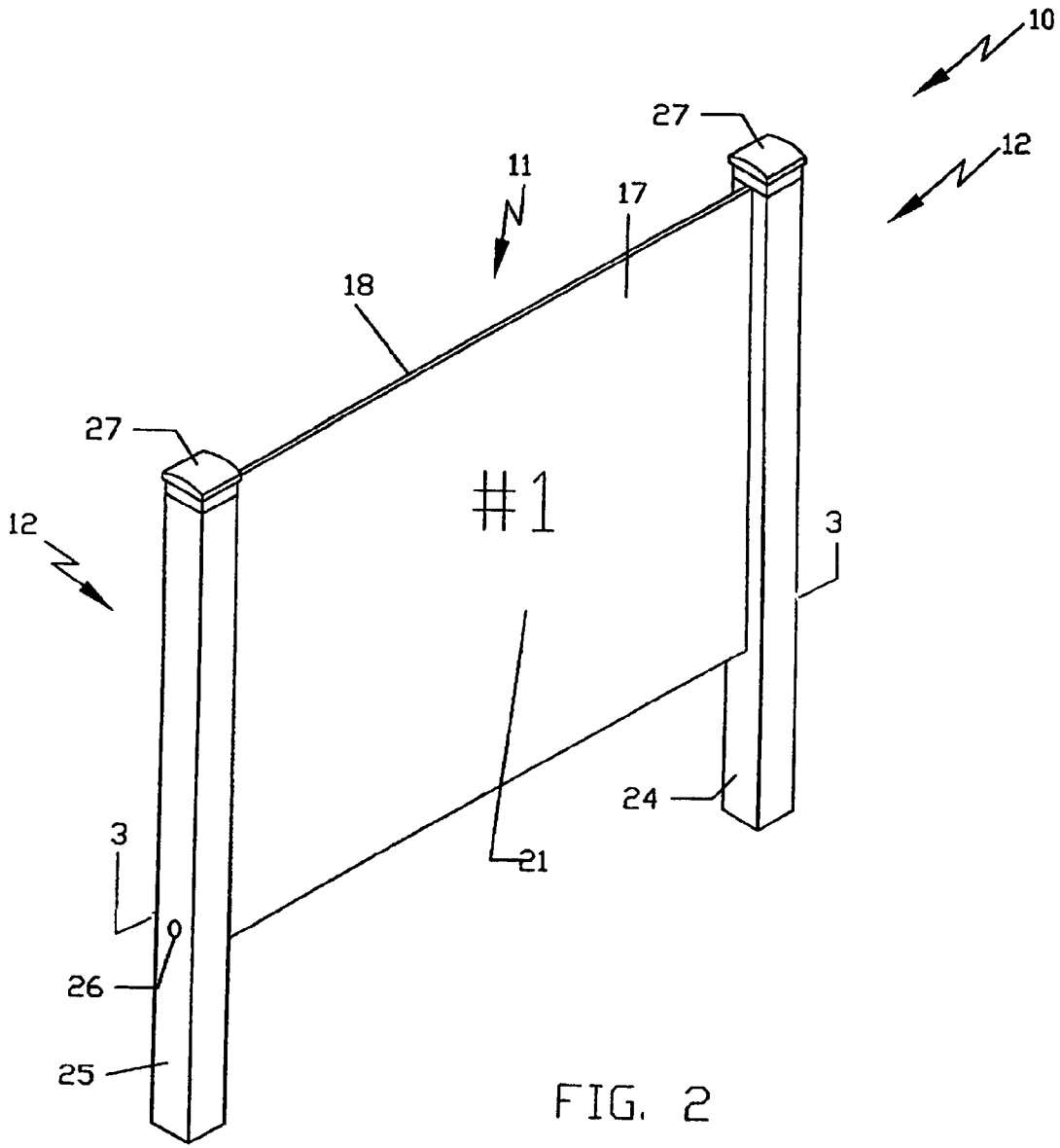
FIG. 2 is a front perspective view of an assembled yard sign according to the present invention.

Turning first to FIGS. 1 and 2, a yard sign assembly 10*a* according to the present invention includes: (a) a central message panel 11; (b) two side posts 12; (c) at least two panel support rods 13; (d) at least one pair of support rod connectors 14 for each of the panel support rods 13; and (e) two removable upper end caps 14. Each side post 12 has a central hollow 15 that is accessible from an upper end of the side post. The yard sign assembly 10 comprises an unassembled position for storage and transport, as seen in FIG. 1, and an assembled, rail-less position for use as seen in FIG. 2.

By "rail-less" is meant that the yard sign 10 does not comprise conventional horizontal rails along the top and bottom edges of the message panel 11. Such rails are not needed herein; the yard sign 10 is strong and durable without rails. A rail-less yard sign is in general easier to manufacture and transport, less expensive, and less complicated than a sign with rails.

As depicted in FIGS. 1, 3, 4, and 6, the central message panel 11 comprises a lightweight, thermoplastic core 16, a lightweight metallic front face sheet 17, a lightweight metallic rear face sheet 18, and a number of panel apertures 19 hidden within the core 16. The front and rear face sheets 17, 18 are attached to, and preferably laminated onto, opposite sides of the core 16. Each panel aperture 19 extends from one end of the central panel 11 to an opposite end of the central panel along a longitudinal axis of the central panel, as seen in FIG. 1. The panel apertures 19 are substantially parallel to one another. The panel apertures 19 are concealed by the front and rear face sheets 17, 18 of the central panel 11.

Preferably, the central panel is a commercially available panel having aluminum front and rear face sheets 17, 18 that are laminated onto the opposite sides of a core 16 of corrugated polypropylene. The aluminum face sheets 17, 18 are preferably the same as one another, scratch-resistant, and quite thin, even in comparison to the thickness of the core. The thickness of each face sheet 17, 18 is between about 1/10 and about 1/5 the thickness of the core 16. Even though it is quite strong, the central panel 11 is also thin. The thickness of the central panel 11 is preferably between about 1 and about 20 percent, more preferably between about 5 and 15 percent, of the thickness of the inside wall 24 of the side post 12. The thickness of the central panel is measured from the outside of the front face sheet to the outside of the rear face sheet. The thickness of the inside wall is the distance between its longitudinal edges.

Figure 3:
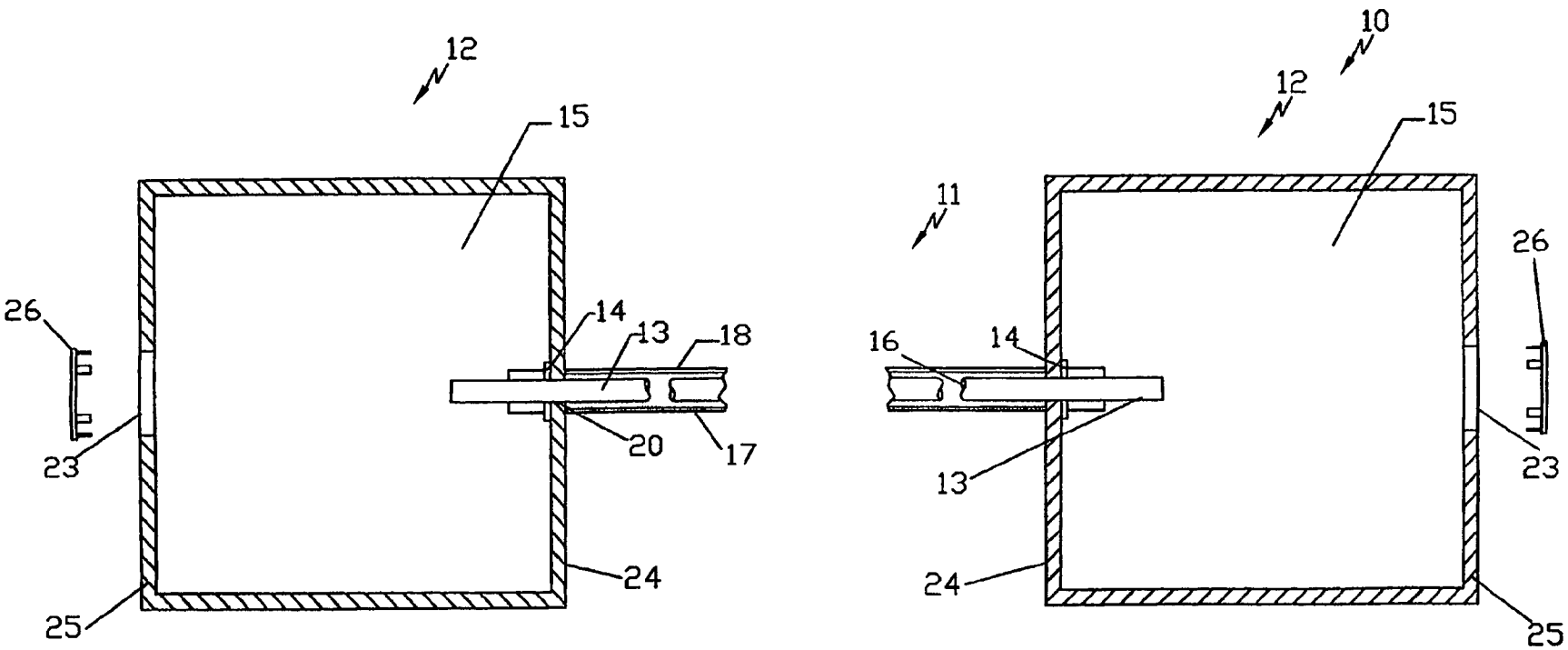
FIG. 3 is a cross-sectional view of the yard sign according to FIG. 2, taken across line 3-3.
Figure 4:
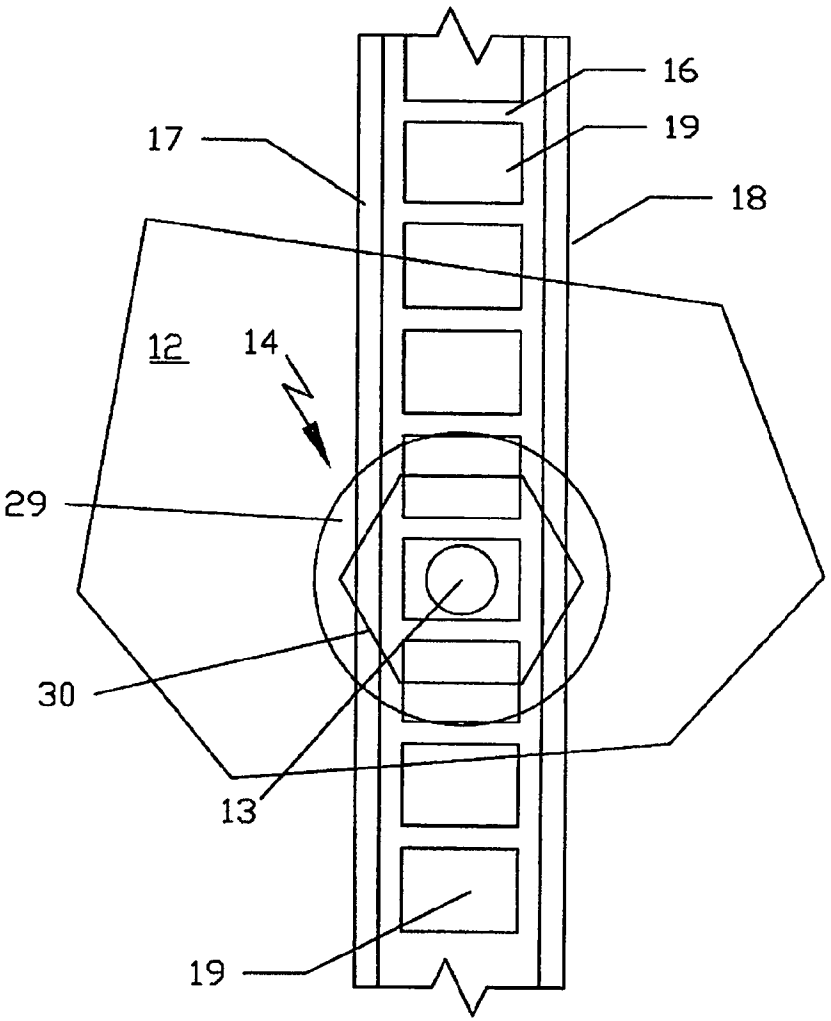
FIG. 4 is a schematic cross-sectional view of a portion of a yard sign according to the present invention, showing the central panel and a portion of one side post.

When the yard sign 10 is in the assembled position, the two side posts 12 are substantially parallel to and spaced apart from one another, with the central panel 11 between the side posts 12 as seen in FIG. 2, and the support rods 13 are substantially parallel to and spaced apart from one another. Each support rod 13 extends substantially perpendicularly to a longitudinal axis of the side posts 12 as seen in FIG. 1. Each of the support rods 13 extends closely through a different one of the panel apertures 19 from one end of the central panel 11 to the opposite end of the central panel 11, as seen in FIG. 3.

As seen in FIG. 2, the assembled yard sign 10 has an advertising message 21 on the front face sheet 16 of the central panel 11, and ordinarily also on the rear face sheet 17. Paint, ink, or vinyl letters or designs, for example, can be used to place the advertising message 21 on the face sheet. Vinyl letters or designs, for example, are applied to the surface of the front face sheet and/or the rear face sheet.

Figure 5:
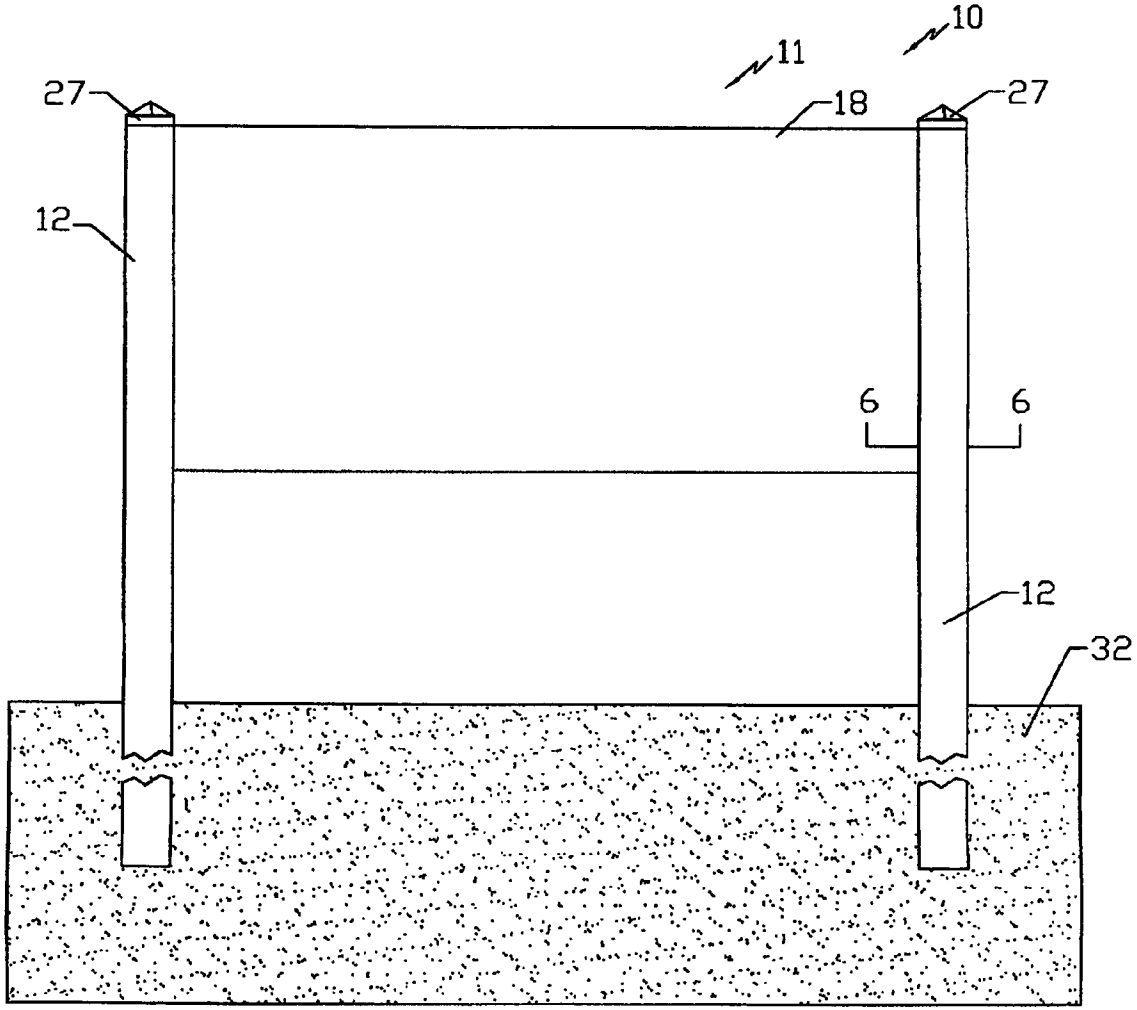
FIG. 5 is a rear elevational view of a yard sign according to the present invention.

The panel apertures 19 in the end edges 28 of the central panel 11 cannot be seen by an observer because the panel ends 28 are pressed against, and concealed by, the side posts 12 as depicted in FIGS. 2 and 5. As seen in FIG. 1, the end edges 28 of the central panel 11 need not be concealed, or covered over, during manufacture. An edge trim can be placed between each end of the central panel and the inside wall 24 of the side post 12, if desired.

The top and bottom edges of the central panel 11 need not be finished, or covered, although they can be if desired. However, the central panel 11 does not have a rail at the top or bottom of the central panel 11. The yard sign 10 does not require rails (or braces) at the top or bottom of the central panel for sturdiness. The top and/or bottom edges of the central panel 11 need not be straight as shown. The top and bottom panel edges can be stepped, curved, or otherwise ornamented for aesthetic purposes. The central panel 11 can be relatively wide or narrow, as desired.

Figure 6:
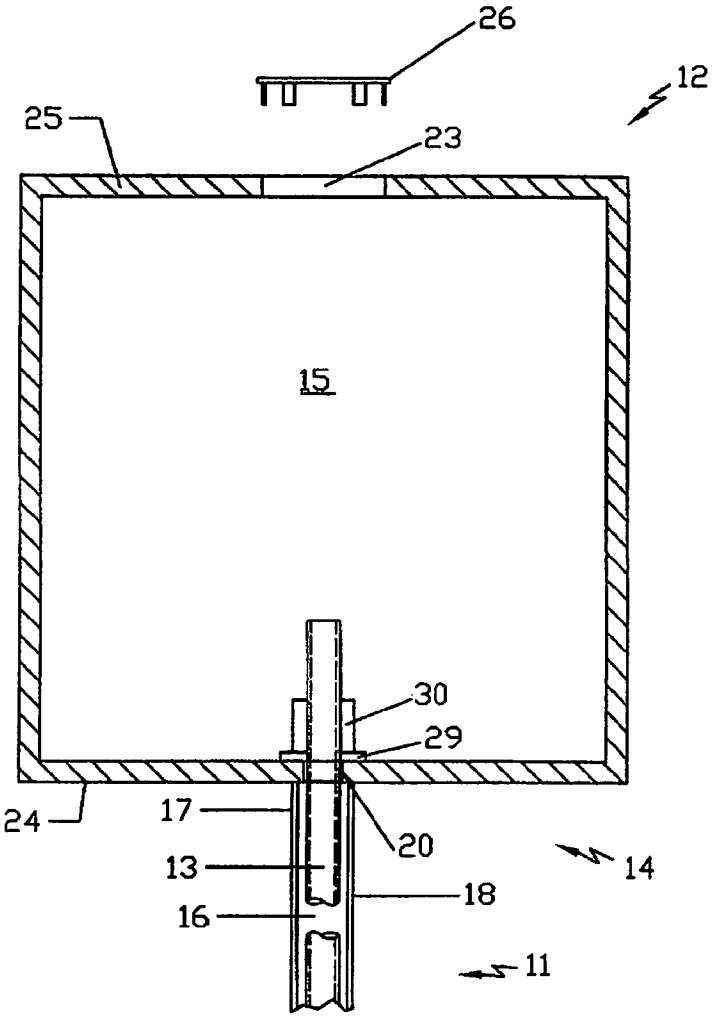
FIG. 6 is a cross-sectional view of a portion of the yard sign according to FIG. 5, taken across line 6-6.

Each side post 12 is substantially rectangular in cross-section, as seen in FIGS. 3 and 6. Each side post 12 comprises two inside side post apertures 20 on the inside wall 24, which is the side that faces the central panel, of each of the side posts 12. Each side post 12 includes an outside side post aperture 23 in an outside side of each side post, and a plug 26 or the like that can be inserted in the outside side post aperture 23 once the yard sign 10 has been assembled in order to prevent water from entering and to conceal the outside side post aperture. The distance between the two inside side post apertures 20 is about the same as the distance between the two support rods 13 in the assembled yard sign 10. A line between the two inside side post apertures 20 would be substantially parallel to the longitudinal side edges of the side posts 12. One post end cap 27 fits over or into the upper end of each of the side posts 12. The end cap 27 preferably has a bottom flange that fits closely into the upper end of the side post 12. The side posts 12 and post end caps 27 are preferably made of polyvinylchloride. Even though the yard sign 10 is preferably white or off-white, it does not require painting and is unlikely to chip or crack over time.

The term "substantially rectangular in cross-section" is meant to include the preferred substantially square in cross section. The hollow 15 in the upper end portion of the side post 12 is large enough for a worker's hand to extend down into it from the upper end of the side post 12, so that the yard sign 10 can be assembled as described herein. The hollow 15 is preferably between about two and about eight inches square, more preferably between about four and six inches square. The hollow need not extend the length of the side post.

The support rods 13 each extend substantially perpendicularly to a longitudinal axis of the side posts 12. The support rods 13 extend substantially horizontally and the side posts 12 extend substantially vertically in an assembled yard sign 10 in the field as seen in FIG. 5. The support rods 13 are concealed by the central panel 11 in the assembled yard sign 10. Although the ends of the support rods 13 extend out beyond the ends of the central panel 11, the support rod ends cannot be seen because they extend through the inside side post holes 20 into the hollow 15 of the side posts 12 (see FIG. 3). The public only sees the attractive capped side posts 12 and the face sheets 17, 18 of the central message panel 11.

Once the support rods 13 have been threaded through the desired panel apertures 19, the inside side post apertures 20 are aligned with the ends of the support rods 12 (see FIG. 3) and the ends of the two panel support rods 13 are inserted into the two inside side post apertures 20 in each side post 12. The side posts 12 are now adjacent the end edges 28 of the central panel 11. The ends of the uppermost support rod 13 are visible in the hollow 15 of each side post 12. The person assembling the sign 10 reaches into each side post hollow 15 from the top of the side post and affixes the support rod connectors 14 to the ends of the uppermost support rod. The ends of the support rod 13 are preferably threaded, and the support rod connector 14 preferably comprises a washer 29 and a retaining nut 30 that screws onto the threaded end of the support rod (see FIGS. 1, 3, and 4). The support rods are preferably made of metal.

Before or after affixing the support rod connectors 14 to the upper support rod 13, the lower support rod connectors 14 must be affixed. The sets of support rods 13 and connectors 14 prevent the central panel 11 from wobbling even when the sign 10 is subjected to adverse weather conditions. There is no need for an upper outside side post aperture because the ends of the uppermost support rod 13 are accessible through the top of the uncapped side post 12. A tool, such as an appropriately sized nut driver, is preferably inserted through the outside side post aperture 23. The outside side post aperture 23 is just large enough to fit the support rod connector 14, and the end of the tool, through it. The whole yard sign 10 can be assembled using only the one tool.

Once the support rod connector 14 has been affixed to the end of the lower support rod 13 in the side post hollow 15, the optional post plug 26 is placed in the outside side post aperture 23, as seen in FIGS. 2, 3, 6, and 7. Where the sign has more than two support rods, as for a large sign, there is an additional outside side aperture in each side post for each additional rod. The plug is preferably made of nylon that is the same color as the side post. The end caps 27 are placed over the open tops of the side posts 12. The end caps 27 may include decorative architectural features, such as a globe shape on top.

Figure 7:
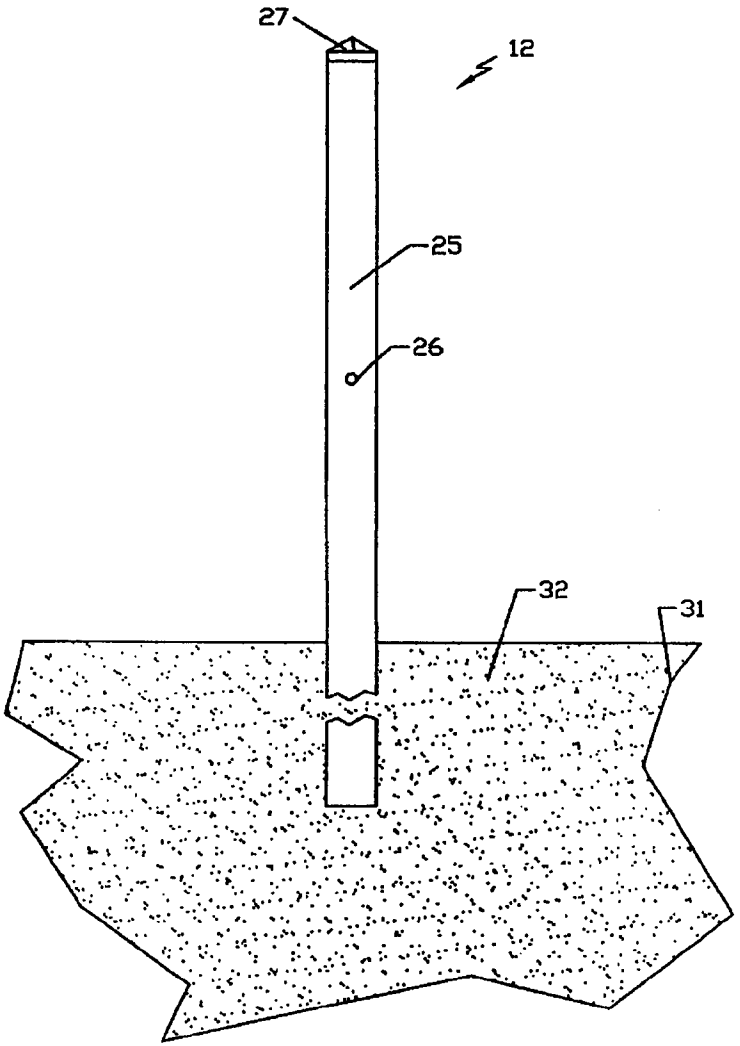
FIG. 7 is a side elevational view of the yard sign according to FIG. 5.

Referring to FIGS. 5 and 7, steps for placing the yard sign 10 include the following: 1) dig a first side post hole 31 in a desired location in the ground for the first side post 12; 2) dig a similarly sized second side post hole 31 for the second side post 12 at a sufficient distance from the first side post hole; 3) insert the bottom end portions of the side posts 12 in the side post holes 31, level the side posts 12 on all sides of each side post; and 4) pour concrete 32 or another suitable filler in the side post holes 31 around the bottoms of the side posts 12, if permanent installation is desired, and allow concrete to harden. Tips for proper assembly are as follows. For a four inch sign post 24 inches deep in the ground, dig an eight inch side post hole. Maintain the same measurement at the top and bottom of the yard sign 10 between the side posts. If sign height is required to be more than about 72 inches in height, ten foot high side posts are preferred. Proper maintenance and cleaning will prolong the life of the yard sign 10.

No slots, channels, or grooves in or on the side posts are required herein. Since the side posts 12 are capped and do not have slots, channels or grooves, they are less susceptible to leakage from rainwater or snow. Although the end edges of the central panel 11 rest against the side posts 12, they are not affixed in the side posts. In the present invention, the two side posts 12 are connected by the panel support rods 13, which is believed to make the sign 10 sturdier even when it is subjected to bad weather conditions. No retaining pins are required to hold in the central panel.

Figure 8:
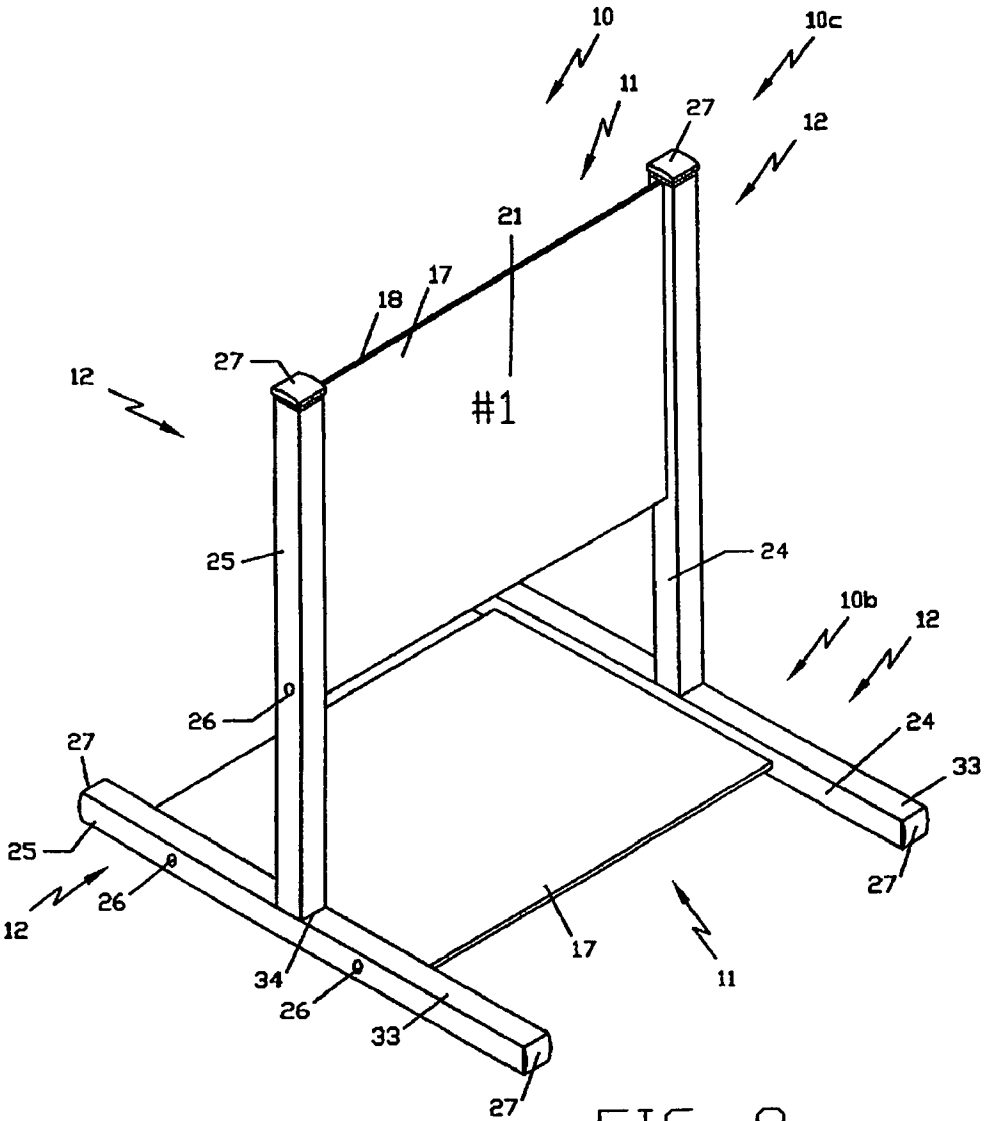
FIG. 8 is a front perspective view of a free-standing, double yard sign according to the present invention.

The yard sign 10 need not be mounted in the ground as seen in FIG. 7. Turning to FIG. 8, a free-standing and portable yet sturdy "double" yard sign 10*c* herein incorporates a first, upright (substantially vertical) main sign 10 with a second, substantially horizontal sign 10*b* at its base. The second, substantially horizontal, base sign 10*b*, which lies on the ground or the like, supports the first, main sign 10. Thus, the two signs 10, 10*b* are substantially perpendicular to one another, preferably forming an upside down T-shape. The second, base sign 10*b* stabilizes the first, main sign 10, so that the double sign 10*c* is unlikely to be torn apart by weather, impacts, etc., despite its portability. Since it is free-standing, the double sign 10*c* can be placed on concrete sidewalks, parking lots, floors, etc.

Continuing with FIG. 8, the first, main sign 10 and the second, base sign 10*b* are as described herein, with the following qualifications regarding the second, base sign 10*b*. First, the second, base sign 10*b* need not have a message inscribed on its central panel 11. Second, both ends of the side posts 12 of the second, base sign 10*b* are capped with post end caps 27.

Third, the base side posts 12 each have two outside side post apertures 23 instead of just one. The central panel 11 of the second, base sign 10*b* includes at least two of the hidden support rods 13 attached to the base side posts 12. Once the base support rod connectors 14 are placed, each base outside side post aperture 23 is filled by a post plug 26. If the end portions of the side posts 12 of the second, base sign 10*b* are sufficiently short for a person to reach in and place the base support rod connectors 14 from the ends of the hollow base side posts 12, no outside side post apertures are needed. The central panel 11 of the second, base sign 10*b* may have more than two support rods, each extending through a different panel aperture 19, if desired.

Last but not least, the bottom of the side posts 12 of the first, main sign 10 are mounted in a punch out 34 in the center of a third, front post wall 33 of each base side post 12, so that the first, main sign 10 stands upright as seen in FIG. 8. The bottoms of the main side posts 12 are adhered in place. The side posts 12 of the second, base sign 10*b* are somewhat larger (wider) than the side posts 12 of the first, main sign 10, so as to accommodate the base side posts in this manner. The base side posts of the second, base sign 10*b* can be as long as is necessary to support the first, main sign 10 without it tipping over. The hollows 15 of the side posts 12 of the second, base sign 10*b* may be filled with concrete to weight the "double" sign 10*c*, if desired.

Although the face sheets 17, 18 of the central panel 11 of the first, main sign 10 preferably each bear an advertising message, the central panel 11 of the second, base sign 10*b* does not. In each of the two signs, the side posts 12 are substantially parallel to and spaced apart from one another, the support rods 13 are substantially parallel to and spaced apart from one another, and each support rod 13 extends substantially perpendicularly to a longitudinal axis of the side posts 12, as seen in FIG. 8. In each of the two signs 10, 10*b*, opposite end portions of each of the support rods 13 extend through corresponding ones of the inside side post apertures 20 in each of the side posts 12 into the side post hollow 15.

From the foregoing it can be realized that the described device of the present invention may be easily and conveniently utilized as a yard sign. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 yard sign
11 central panel
12 side posts
13 panel support rods
14 support rod connectors
15 side post hollow
16 panel core
17 front face sheet
18 rear face sheet
19 panel apertures
20 inside side post apertures
21 advertising message
23 outside side post aperture
24 inside wall of side post
25 outside wall of side post
26 post plug
27 upper end cap
28 panel end edges
29 washer
30 retaining nut
31 post hole
32 concrete filler
33 front post wall
34 punch out

What is claimed is:

1. A free-standing, double yard sign, comprising: a first, substantially vertical main sign and a second, substantially horizontal base sign, the second, substantially horizontal base sign being substantially perpendicular to and supporting the first, substantially vertical main sign, each sign comprising:

(a) a central panel comprising a lightweight, thermoplastic core, a lightweight metallic front face sheet, a lightweight metallic rear face sheet, and a plurality of panel apertures within the core; the front and rear face sheets being attached to opposite, front and rear sides of the core; each panel aperture extending from one end of the central panel to an opposite end of the central panel along a longitudinal axis of the central panel, the panel apertures being substantially parallel to one another;

(b) two side posts, each side post comprising a central hollow, each side post being substantially rectangular in cross-section, each side post comprising at least two inside side post apertures on an inside wall of each of the side posts, and at least one outside side post aperture on an outside wall of each of the side posts;

(c) at least two panel support rods, each support rod extending through a different one of the panel apertures from one end of the central panel to the opposite end of the central panel;

(d) at least one pair of support rod connectors, each support rod connector being connected to an end of the at least two panel support rods; and (e) two removable upper end caps, one end cap fitting over an upper end of each of the side posts;

wherein the side posts of the second, base sign comprise a central punch out, a lower end of each of the side posts of the first, main sign being attached in the central punch out of a corresponding one of the side posts of the second, base sign, the side posts of the second, base sign being substantially wider than the side posts of the first, main sign.

2. The double yard sign according to claim 1, wherein the face sheets of the central panel of the first, main sign each bear an advertising message.

3. The double yard sign according to claim 1, wherein, in each of the two signs, the side posts are substantially parallel to and spaced apart from one another, the at least two support rods are substantially parallel to and spaced apart from one another, and the at least two support rods each extend substantially perpendicularly to a longitudinal axis of the side posts.

4. The double yard sign according to claim 1, wherein, in each of the two signs, opposite end portions of each of the support rods extend through corresponding ones of the inside side post apertures in each of the side posts into the side post hollow.

5. The double yard sign according to claim 1, wherein the central panel of the second, base sign does not bear an advertising message.

6. The double yard sign according to claim 1, wherein both ends of the side posts of the second, base sign are capped with post end caps.

7. The double yard sign according to claim 1, wherein the side pasts of the second, base sign each comprise two of the outside side post apertures.

* * * * *